US006450672B2

(12) United States Patent
Gismondi

(10) Patent No.: US 6,450,672 B2
(45) Date of Patent: Sep. 17, 2002

(54) MULTIPURPOSE LIGHTING DEVICE

(75) Inventor: Ernesto Gismondi, Milan (IT)

(73) Assignee: Artemide S.p.A., Milan (IT)

( * ) Notice: Subject to any disclaimer, the term of this patent is extended or adjusted under 35 U.S.C. 154(b) by 0 days.

(21) Appl. No.: 09/809,402

(22) Filed: Mar. 15, 2001

(30) Foreign Application Priority Data

Mar. 17, 2000 (IT) ..... MI00U0165

(51) Int. Cl.[7] ..... F21S 8/00

(52) U.S. Cl. ..... 362/427; 362/413; 362/287; 362/269

(58) Field of Search ..... 362/235, 413, 362/414, 238, 239, 282, 129, 147, 287, 427, 269

(56) References Cited

U.S. PATENT DOCUMENTS 2,850,622 A 9/1958 Johnson
3,178,569 A 4/1965 Martin
5,825,637 A 10/1998 Chen

FOREIGN PATENT DOCUMENTS

DE 17 28 493 7/1973
FR 2 752 454 A 2/1998

*Primary Examiner*—Sandra O'Shea
*Assistant Examiner*—Ali Alavi
(74) *Attorney, Agent, or Firm*—Pitney, Hardin, Kipp & Szuch, LLP

(57) ABSTRACT

A lighting device, in particular a standard lamp, having a stand, an upright, a shade, and lamp-holder means located inside the shade; the upright supporting the lamp-holder means and the shade; the shade having a through opening defined by opposite facing lateral walls, and through which the upright is inserted; and the lamp-holder means including a sleeve, to which the shade is connected integrally, and which is fitted to the upright to rotate about an axis of rotation perpendicular to the facing lateral walls of the opening in the shade, so that the shade may selectively assume at least three positions forming different angles with the upright.

7 Claims, 2 Drawing Sheets

MULTIPURPOSE LIGHTING DEVICE

The present invention relates to a multipurpose lighting device, wherein the diffusion direction of the light may be adjusted by the user as required. Though specific reference is made in the following description to a lighting device defined by a standard lamp, the invention is, obviously, in no way to be inferred as being limited to this particular application.

BACKGROUND OF THE INVENTION

Standard lamps, both table-top and floor types, pose the problem of achieving the best light diffusion in different situations. For example, a standard lamp may be used to illuminate a room with diffused, normally indirect, light by directing the light beam towards the ceiling; or to illuminate the area beneath the lamp (especially in the case of floor lamps) by directing the beam downwards; or to mainly illuminate areas around the lamp by directing the beam obliquely.

All these requirements are currently met by quartz-iodine lamps with adjustable reflectors, but which do not always go with the type of decor involved. In particular, decidedly "classic" furnishing schemes call for lamps with wide shades which, if applied to lamps with adjustable reflectors, rule out any possibility of obtaining different lighting effects.

SUMMARY OF THE INVENTION

It is an object of the present invention to solve the above problem by providing a lighting device—particularly, though not exclusively, a standard lamp—which is cheap and easy to produce, is highly effective, and permits the use of lamp-shades while at the same time enabling adjustment of the predominant lighting direction of the device.

According to the present invention, there is provided a lighting device, in particular a standard lamp, comprising a shade; lamp-holder means located inside the shade; a supporting member supporting said lamp-holder means and the shade; and supporting means for supporting the supporting member; characterized in that, in combination: the supporting member is defined by an upright having a free first end and a second end, opposite the first, connected to the supporting means; the shade has a through opening defined by opposite facing lateral walls, and through which the upright is inserted; and the lamp-holder means include a sleeve to which the shade is connected integrally, and which is fitted to said first end of the upright so as to rotate about an axis of rotation perpendicular to said facing lateral walls of the opening in the shade, and so that the shade may selectively assume a number of predetermined positions forming different angles with the upright.

As such, the various lighting requirements of a given room area can be met by one device in one location, by simply rotating the shade-sleeve assembly manually, and without forgoing a shade, which may be of any size or design, and may be defined by a diffusing screen made of any material: glass, cloth, plastic, etc.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 2:
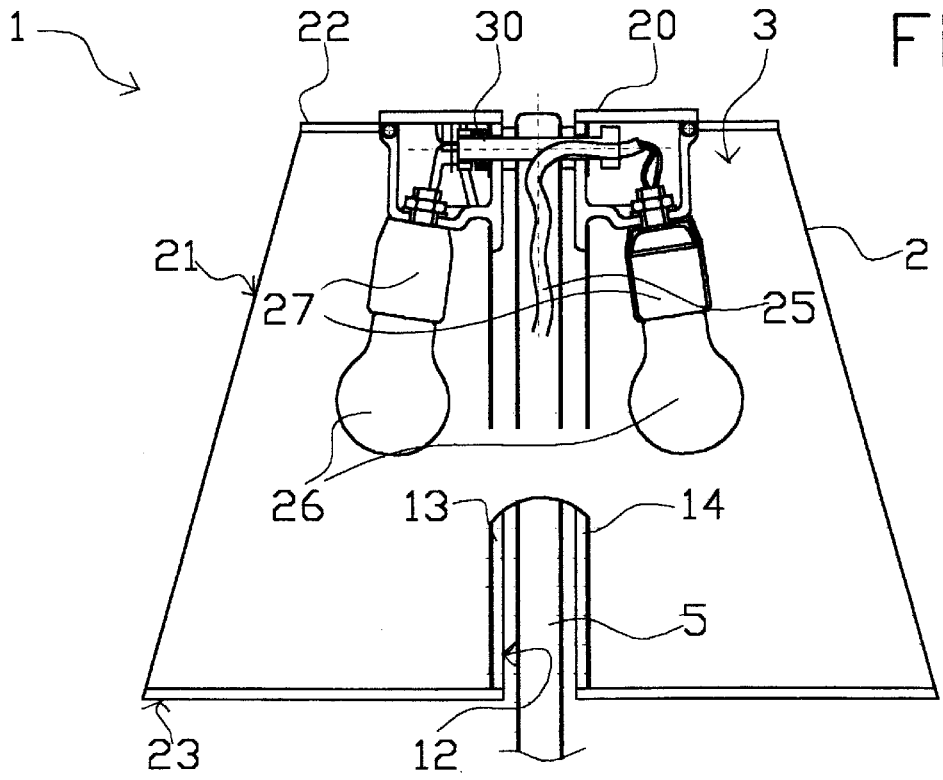
FIG. 2 shows a partly sectioned, larger-scale detail of the FIG. 1 device.

With reference to FIGS. 1 to 5, number 1 indicates as a whole a lighting device, which, in the non-limiting example shown, is a standard lamp comprising a shade 2; lamp-holder means 3 located inside shade 2; a supporting member supporting lamp-holder means 3 and shade 2 and defined by an upright 5; and supporting means for supporting supporting member 5 and defined by a known floor (or table-top) stand 7, from which upright 5 projects vertically. Upright 5 therefore has a free first end 8; and a second end 9, opposite end 8, connected to the supporting means and, in the example shown, fitted to stand 7.

According to the invention, shade 2 comprises a through opening 12 defined by opposite facing lateral walls 13, 14 and through which upright 5 is inserted; and, in combination, lamp-holder means 3 include a sleeve 20, to which shade 2 is connected integrally, and which is fitted for rotation to upright 5 at end 8, which, in the application shown, is the top end.

Figure 1:
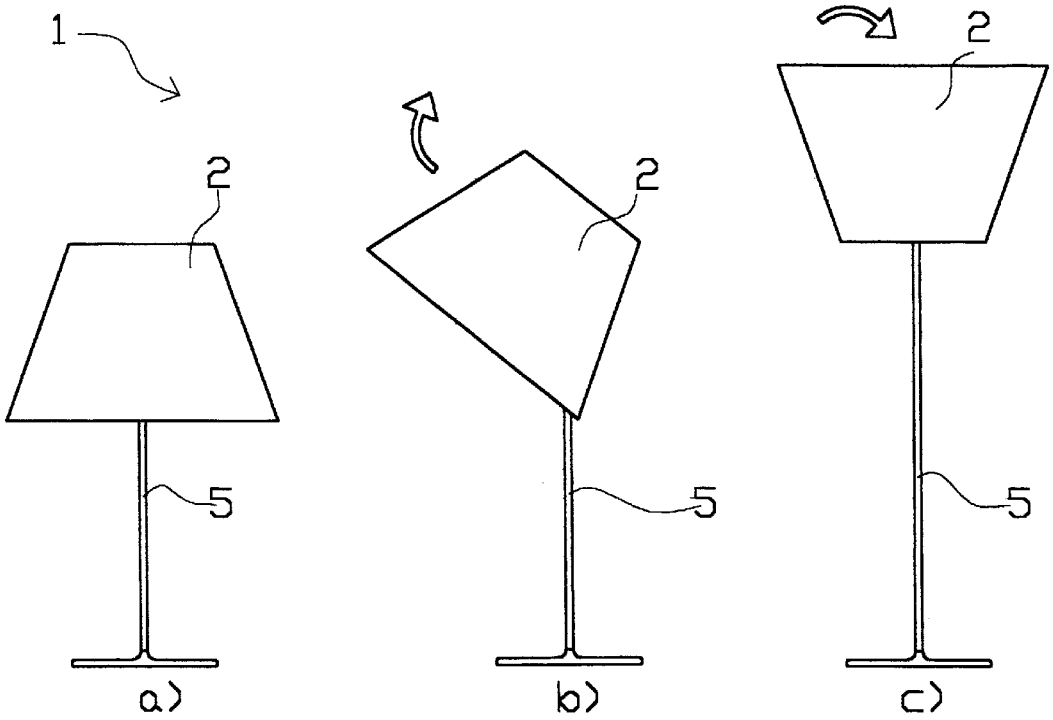
FIG. 1 shows the various operating positions of a lighting device in accordance with the invention.
Figure 4:
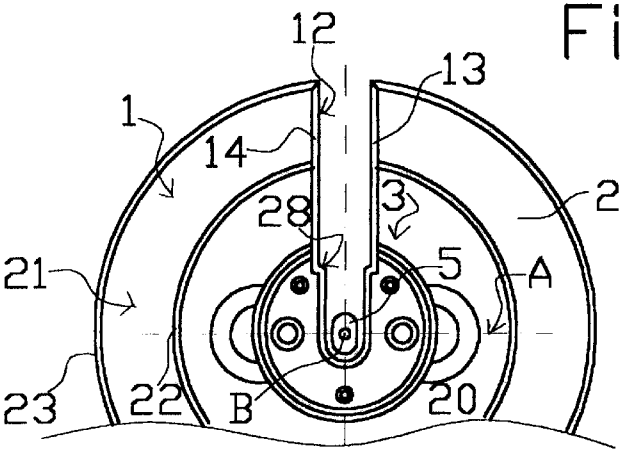
FIG. 4 shows a top-plan view of the FIGS. 1, 2, 3 device.
Figure 5:
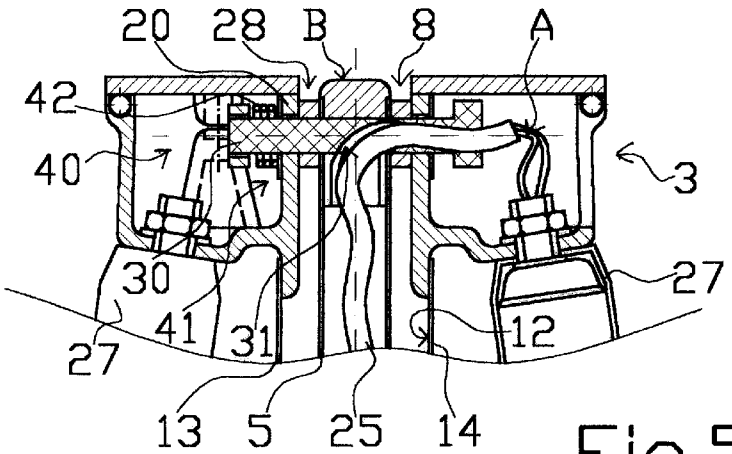
FIG. 5 shows a larger-scale view of a portion of the FIG. 2 detail.
Figure 3:
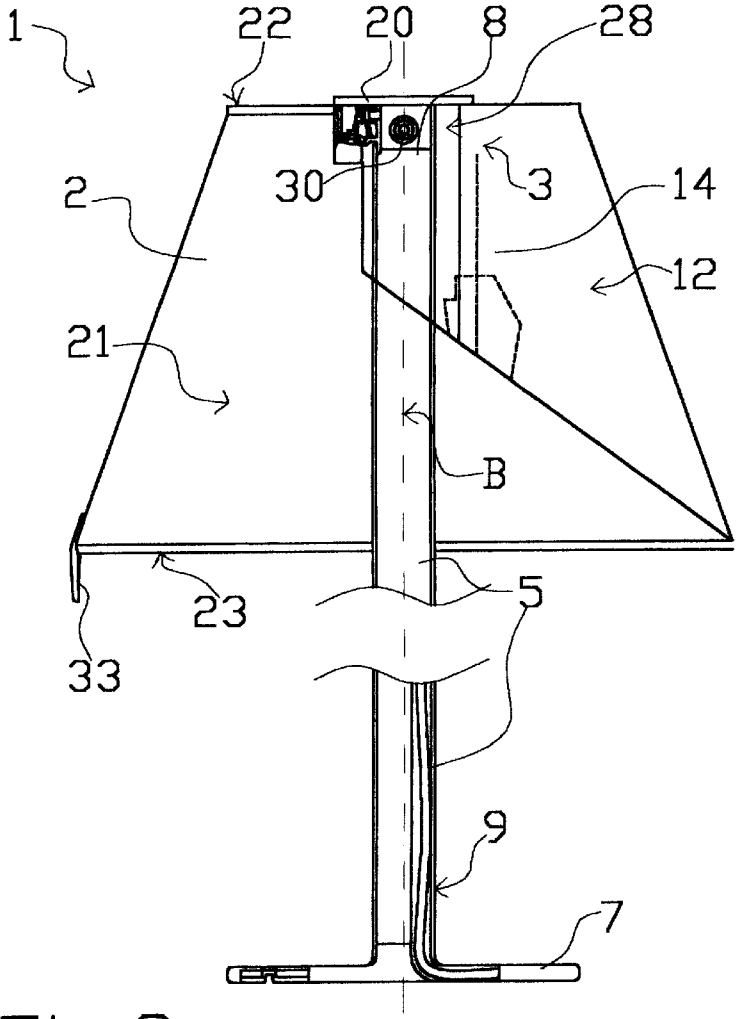
FIG. 3 shows a partly sectioned side view of the device according to the invention rotated 90° with respect to FIG. 2.

More specifically, sleeve 20 and integral shade 2 are rotatable about an axis of rotation A (FIGS. 4, 5) perpendicular to facing lateral walls 13, 14 of through opening 12 in shade 2, so that, as will be seen, shade 2 may selectively assume a number of predetermined positions forming different angles with uptight 5: in particular, the three positions indicated a), b) and c) in FIG. 1.

Shade 2 is defined by a diffusing screen in turn defined by a lateral wall 21 pervious to light and defined by a surface of revolution; opening 12 is located along a generating line of the surface of revolution; and facing walls 13, 14 defining opening 12 are parallel to each other and extend along diametric chords (i.e. parallel to the diameter) of the surface of revolution. In the non-limiting example shown, the surface is conical, and shade 2 is truncated-cone-shaped and defined at the top and bottom by two opposite peripheral end edges 22, 23.

Shade 2 may be made of any material, including cloth, providing it has an adequately rigid supporting structure. Shade 2 is connected at edge 22 to and projects from sleeve 20 in known manner, and upright 5 preferably has a flat cross section (FIG. 4) extending parallel to facing walls 13, 14, so that the circumference of opening 12 is as small as possible.

Upright 5 is tubular and houses an electric power lead 25, e.g. for two bulbs 26. More specifically, sleeve 20 is substantially in the form of a circular drum, the face of which away from edge 22 supports two conventional lamp-holders 27 for bulbs 26; and, for assembly to upright 5, sleeve 20 has a U-shaped transverse radial seat 28 (FIG. 4) extending axially through the whole of the sleeve, and through which end 8 of upright 5 is fitted.

Seat 28 is fitted through transversely with a pin 30 coaxial with axis A and forming the pivot (axis of rotation) of the shade 2-sleeve 20 assembly. Pin 30 is fixed through end 8 of upright 5, and has an inner axial passage 31 (FIG. 5) through which power lead 25 is inserted inside sleeve 20 for connection to both lamp-holders 27 in conventional manner.

Sleeve 20 is fitted idly to fixed pin 30; and U-shaped seat 28 of the sleeve and lateral walls 13, 14 defining opening 12 in shade 2 extend beyond an axis of symmetry B of sleeve 20, coincident with the axis of symmetry of upright 5 and of the surface of revolution defining lateral wall 21, by such an amount as to enable 180° rotation of sleeve 20 about pin 30 in a predetermined direction shown by the arrow (in FIG. 1) and away from opening 12.

For easy rotation, edge 23 of shade 2 is provided with a projecting grip 33 on the opposite side to opening 12.

To lock the shade 2-sleeve 20 assembly firmly in each set angular position, pin 30 supports selective locking means indicated as a whole by 40 and comprising (FIG. 5) a clutch 41 loaded by a spring 42, and, preferably, selective stops defined by conventional reference notches (not shown) formed, for example, on clutch 41, or on the relative rotation surfaces of pin 30 and sleeve 20, or on the friction surfaces of upright 5 and sleeve 20.

What is claimed is:

1. A lighting device, in particular a standard lamp, comprising a shade; lamp-holder means located inside the shade; a supporting member supporting said lamp-holder means and the shade; and supporting means for supporting the supporting member; characterized in that, in combination: the supporting member is defined by an upright having a free first end and a second end, opposite the first, connected to the supporting means; the shade has a through opening defined by opposite facing lateral walls, and through which the upright is inserted; and the lamp-holder means include a sleeve to which the shade is connected integrally, and which is fitted to said first end of the upright so as to rotate about an axis of rotation perpendicular to said facing lateral walls of the opening in the shade, and so that the shade may selectively assume a number of predetermined positions forming different angles with the upright.

2. A device as claimed in claim 1, characterized in that the supporting means are defined by a stand, from which said upright extends vertically; said shade being defined by a diffusing screen in turn defined by a lateral wall pervious to light and defined by a surface of revolution; said opening being located along a generating line of said surface of revolution; and said facing walls defining said opening being parallel to each other and extending along diametric chords of said surface of revolution.

3. A device as claimed in claim 2, characterized in that said shade is connected by a first peripheral edge to, and projects from, said sleeve; and in that said upright has a flat cross section extending parallel to said facing walls defining the opening in the shade.

4. A device as claimed in claim 1, characterized in that said upright houses an electric power lead; said sleeve being substantially in the form of a circular drum, and having a U-shaped transverse radial seat engaged by said upright and fitted through with a pin, which defines said axis of rotation, is fixed through said upright, and has an inner axial passage through which said electric power lead is inserted inside the sleeve.

5. A device as claimed in claim 4, characterized in that said sleeve is carried idly by said fixed pin; and in that the U-shaped seat of the sleeve and said lateral walls defining the opening in the shade extend beyond an axis of symmetry of the sleeve, coincident with the axis of symmetry of the upright and of said surface of revolution, by such an amount as to enable 180° rotation of the sleeve about said pin in a predetermined direction away from said opening.

6. A device as claimed in claim 5, characterized in that said shade is provided with a projecting grip on a second peripheral edge opposite the first, and on the opposite side to said opening.

7. A device as claimed in claim 5, characterized in that said pin supports selective locking means for selectively locking said sleeve and said shade, integral with the sleeve, in said number of predetermined positions.

* * * * *